US006848763B2

(12) United States Patent
Sumi

(10) Patent No.: US 6,848,763 B2
(45) Date of Patent: Feb. 1, 2005

(54) DRIVE UNIT FOR LIQUID EJECTION HEAD

(75) Inventor: Koji Sumi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/108,980

(22) Filed: Mar. 29, 2002

(65) Prior Publication Data

US 2002/0154195 A1 Oct. 24, 2002

(30) Foreign Application Priority Data

Mar. 30, 2001 (JP) ..... 2001-101285
Mar. 29, 2002 (JP) ..... 2002-093981

(51) Int. Cl.[7] ..... B41J 29/38
(52) U.S. Cl. ..... 347/10; 347/11; 347/68
(58) Field of Search ..... 347/10, 11, 68, 347/69; 310/358, 333, 317

(56) References Cited

U.S. PATENT DOCUMENTS

| | | | | |
|---|---|---|---|---|
| 4,577,201 A | | 3/1986 | Murakami et al. | 347/68 |
| 4,988,909 A | * | 1/1991 | Hagimura et al. | 310/358 |
| 5,202,703 A | | 4/1993 | Hosington et al. | 347/68 |
| 5,466,985 A | * | 11/1995 | Suzuki | 310/333 |
| 5,790,156 A | * | 8/1998 | Mutton et al. | 347/71 |
| 5,923,352 A | * | 7/1999 | Kikuchi et al. | 347/70 |
| 6,140,750 A | * | 10/2000 | Ueyama | 310/369 |
| 6,286,923 B1 | * | 9/2001 | Sugahara | 347/10 |

FOREIGN PATENT DOCUMENTS

| | | |
|---|---|---|
| JP | 09-141866 | 6/1997 |
| JP | 09-226106 | 9/1997 |
| JP | 10-024570 | 1/1998 |

OTHER PUBLICATIONS

English Language Abstract of Japanese Publication No. 09–141866, published Jun. 1997.
English Language Abstract of Japanese Publication No. 09–226106, published Sep. 1997.
English Language Abstract of Japanese Publication No. 10–024570, published Jan. 1998.

* cited by examiner

*Primary Examiner*—Stephen D. Meier
*Assistant Examiner*—Lam Nguyen
(74) *Attorney, Agent, or Firm*—Sterne, Kessler, Goldstein & Fox P.L.L.C.

(57) ABSTRACT

A drive unit for a liquid ejection head in which shrinkage of a pressure chamber and ejection of the liquid are caused by the application of a voltage to a piezoelectric body, wherein: (A) a drive pulse with an electric field exceeding the coercive electric field of the piezoelectric body is applied to the piezoelectric body during the liquid ejection operation such as printing, and (B) a pulse that eliminates polarization remaining in the piezoelectric body is applied to the piezoelectric body when no liquid ejection operation is conducted. As a result, a difference between the elements can be prevented even as time elapses, and a stable ejection characteristic can be obtained.

13 Claims, 6 Drawing Sheets

1: INK-JET RECORDING HEAD

DRIVE UNIT FOR LIQUID EJECTION HEAD

BACKGROUND OF THE INVENTION

1. Field of the Invention

The present invention relates to a drive unit for a liquid ejection head for ejecting a liquid such as ink and the like by controlling the voltage applied to piezoelectric elements. In particular, the present invention relates to a drive unit that adjusts residual polarization of piezoelectric elements while no liquid ejection operation is conducted and minimizes difference between the elements. Further, the present invention also relates to a liquid ejection apparatus such as a printer that is equipped with such a drive unit, and to a drive method for a liquid ejection head.

2. Description of the Related Art

Ink-jet recording heads of an on-demand type comprise pressure chambers in which ink pressure is generated by piezoelectric elements or heat-generating elements, ink chambers supplying the ink into the pressure chambers, and nozzles ejecting the ink from the pressure chambers. Pressure is generated by applying drive signals to the elements corresponding to the printing signals, and ink droplets are ejected from the nozzles onto the recording medium. In particular, the advantage of the ink-jet recording heads using piezoelectric elements over the ink-jet recording heads of other types is that because no heat is used, the degradation of ink and clogging are prevented.

It is well known that in the ink-jet recording heads using piezoelectric elements, the piezoelectric film is subjected to polarization treatment in advance in order to improve the ejection characteristic of ink by the piezoelectric film.

The relationship between strain (S) and electric field (E) in a piezoelectric film is shown in FIG. 7 to explain a concept of polarization treatment. When no polarization treatment is conducted, strain S=0 if the electric field E=0. If the piezoelectric element is driven starting from this state, the strain S rises along the solid line L as the electric field E increases. On the other hand, when the polarization treatment was conducted in advance, the strain S is already above zero because of the polarization if the electric field E=0. If the piezoelectric element is driven starting from this state, the strain S rises along the solid line H as the electric field E increases. Thus, even when the same electric field is applied from the electric field E=0, the higher strain can be obtained with the polarization treatment conducted in advance than without it.

The polarization produced by such polarization treatment is gradually lost with the passage of time. Japanese Patent Laid-open Publication No. 9-141866 discloses re-polarization of a piezoelectric element member by a voltage having the same polarization direction as in an ink ejection. As a result, ink can be ejected in the desired ejection amount even after long-term usage.

The above-described polarization treatment was effective when the head is driven within a range below the coercive electric field. However, if a piezoelectric thin film is used, the electric field for driving is sufficiently higher than the coercive electric field. As a result, the polarization treatment does not fully demonstrate its effect. On the other hand, the piezoelectric thin films tend to loose the residual polarization faster. For this reason, a polarization of an element having a drive history becomes higher than another element not having a drive history, causing a difference between the elements.

Accordingly, it is an object of the present invention to provide a drive unit for a liquid ejection head, which is capable of suppressing the difference in displacement between the piezoelectric elements.

SUMMARY OF THE INVENTION

In a drive unit for a liquid ejection head in accordance with the present invention, shrinkage of a pressure chamber and ejection of the liquid are caused by the application of a voltage to a piezoelectric body, and a drive pulse with an electric field exceeding the coercive electric field of the piezoelectric body is applied to the piezoelectric body during the liquid ejection operation, and a pulse that eliminates polarization remaining in the piezoelectric body is applied to the piezoelectric body when no liquid ejection operation is conducted. As a result, difference in polarization between the elements is eliminated even as time elapses, and a stable ejection characteristic can be obtained.

Furthermore, in another drive unit for a liquid ejection head in accordance with the present invention, shrinkage of a pressure chamber and ejection of the liquid are caused by the application of a voltage to a piezoelectric body, and a drive pulse with an electric field exceeding the coercive electric field of the piezoelectric body is applied to the piezoelectric body during the liquid ejection operation, and a voltage of the same polarity as the drive pulse (positive or negative) is applied and additionally a voltage of the polarity opposite to that of the drive pulse is applied when no liquid ejection operation is conducted. As a result, polarization of piezoelectric elements can be eliminated in both the elements having and not having a drive history.

In the above-described drive unit, the voltage of the same polarity as the drive pulse applied while no liquid ejection operation is conducted is preferably a voltage with an electric field exceeding the coercive electric field of the piezoelectric body. Furthermore, in the above-described drive unit, the pulse that is applied while no liquid ejection operation is conducted is preferably applied at any time period selected from immediately after the power source of the liquid ejection apparatus has been turned on, during cleaning of the head surface, during cartridge replacement, and after the liquid-adhered medium has been discharged.

In another drive unit for a liquid ejection head in accordance with the present invention, shrinkage of a pressure chamber and ejection of the liquid are caused by the application of a voltage to a piezoelectric body. In this drive unit, a first voltage to arise an electric field in the piezoelectric body exceeding its coercive electric field is applied and additionally a second voltage of the polarity opposite to that of said first voltage is applied to said piezoelectric body to eliminate polarization remaining in said piezoelectric body. As a result, difference in polarization between the elements is eliminated even as time elapses, and a stable ejection characteristic can be obtained.

It is also preferred that in the above-described drive unit, the voltage is applied to a piezoelectric thin film.

A liquid ejection apparatus in accordance with the present invention comprises the above-described drive unit. The liquid ejection head is driven by the drive unit for conducting the recording. In the liquid ejection apparatus in accordance with the present invention, the liquid is preferably ink for printing on medium.

In a drive method for a liquid ejection head in accordance with the present invention, shrinkage of a pressure chamber and ejection of the liquid are caused by the application of a voltage to a piezoelectric body. This method comprises steps of applying a drive pulse to the piezoelectric body to apply an electric field exceeding the coercive electric field of the piezoelectric body during the liquid ejection operation, and applying a pulse to the piezoelectric body to eliminate the polarization remaining in the piezoelectric body while no liquid ejection operation is conducted.

In another drive method for a liquid ejection head in accordance with the present invention, shrinkage of a pressure chamber and ejection of the liquid are caused by the application of a voltage to a piezoelectric body. This method comprises steps of applying a drive pulse to the piezoelectric body to apply an electric field exceeding the coercive electric field of said piezoelectric body during the liquid ejection operation, and applying a voltage of the same polarity as the drive pulse (positive or negative) and a voltage of the polarity opposite to that of the drive pulse while no liquid ejection operation is conducted.

In another drive method for a liquid ejection head in accordance with the present invention, shrinkage of a pressure chamber and ejection of the liquid are caused by the application of a voltage to a piezoelectric body. In this method, a first voltage to arise an electric field in the piezoelectric body exceeding its coercive electric field is applied and additionally a second voltage of the polarity opposite to that of said first voltage is applied to said piezoelectric body to eliminate polarization remaining in said piezoelectric body.

DESCRIPTION OF THE PREFERRED EMBODIMENT

The preferred embodiment of the present invention will be described below with reference to the drawings.

(Entire Configuration of Ink-Jet Printer)

Figure 1:
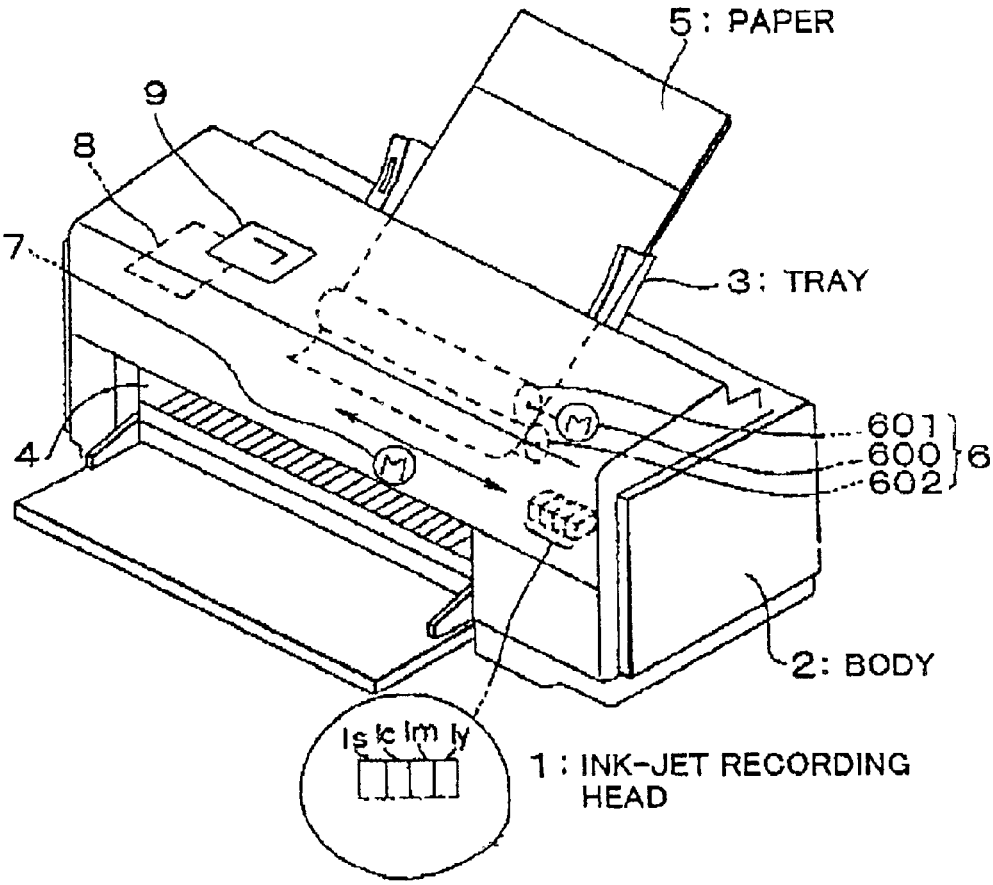
FIG. 1 is a perspective view illustrating the structure of a printer using a drive unit of an embodiment of the present invention.

FIG. 1 is a perspective view illustrating the configuration of a printer which is a liquid ejection apparatus using the drive unit of the present embodiment. In this printer, a tray 3, a release opening 4, and a control button 9 are provided in a body 2. Furthermore, an ink-jet recording head 1, which is a liquid ejection head, a feeding mechanism 6, and a control circuit 8 are provided inside the body 2, The control circuit 8 comprises a drive unit in accordance with the present invention.

The ink-jet recording head 1 comprises the below-described piezoelectric elements. The ink-jet recording head 1 has a structure allowing for the ejection of a liquid such as ink and the like from nozzles in response to ejection signals supplied from the control circuit 8.

The body 2 is a printer case. The feeding mechanism 6 is disposed to allow for medium such as paper 5 to be supplied from the tray 3. The ink-jet recording head 1 is disposed so that printing can be conducted on paper 5. The tray 3 has a configuration allowing for the supply of paper 5 prior to printing to the feeding mechanism 6. The release opening 4 is an outlet opening for releasing paper 5 upon completion of printing by liquid ejection.

The feeding mechanism 6 comprises a motor 600, rollers 601, 602, and other mechanical structure that is not shown in the figures. The motor 600 can rotate in response to drive signals supplied from the control circuit 8. The mechanical structure has a configuration allowing for the transmission of rotation force of motor 600 to rollers 601, 602. Rollers 601, 602 rotate when the rotation force of motor 600 is transmitted thereto. The rotation of rollers 601, 602 pulls in the paper 5 placed into the tray 3 and supplies the paper for printing with the head 1.

The control circuit 8 comprises CPU, ROM, RAM, interface circuit, and the like (not shown in the figure). The control circuit 8 can supply a drive signal to the feeding mechanism 6 or supply an ejection signal to the ink-jet recording head 1 in response to the printing information supplied from a computer via a connector (not shown in the figures). Furthermore, the control circuit 8 sets and resets the operation mode in response to the control signal from the control panel 9.

(Configuration of Ink-Jet Recording Head)

Figure 2:
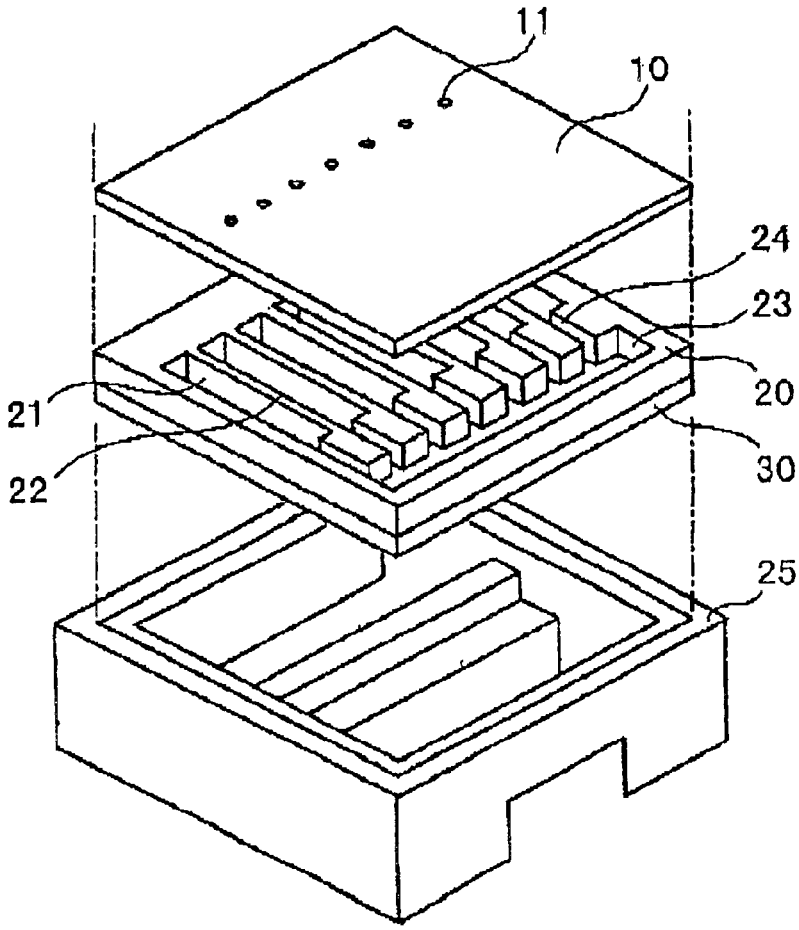
FIG. 2 illustrates a structure of an ink-jet recording head driven by the aforesaid drive unit.

FIG. 2 shows a structure of the ink-jet recording head driven by the drive unit. The ink-jet recording head 1, as shown in the figure, comprises a nozzle plate 10, a pressure chamber substrate 20, and an oscillation plate 30. The head constitutes a piezo-jet head of an on-demand type.

The pressure chamber substrate 20 comprises pressure chambers (cavities) 21, side walls (partitions) 22, reservoirs 23, and supply openings 24. The pressure chambers 21 are the spaces for storing ink which is to be ejected, those spaces being formed by etching in a substrate from silicon or the like. Side walls 22 are formed so as to separate the pressure chambers 21 from each other. The reservoir 23 is a common passage for filling the pressure chambers 21 with ink. The supply openings 24 are formed so that ink can be introduced from the reservoir 23 into the pressure chambers 21.

The nozzle plate 10 is bonded to one surface of the pressure chamber substrate 20 so that the nozzle holes 11 thereof are located in positions corresponding to respective pressure chambers 21 provided in the pressure chamber substrate 20. The pressure chamber substrate 20 having the nozzle plate 10 bonded thereto is enclosed in a case 25 and constitutes the ink-jet recording head 1.

The oscillation plate 30 is bonded to the other surface of the pressure chamber substrate 20. Piezoelectric elements (not shown in the figure) are provided on the oscillation plate 30. An ink tank (not shown in the figure) is provided in the oscillation plate 30, and the ink stored in the ink tank that is not shown in the figures can be supplied into the pressure chamber substrate 20.

(Layered Structure)

Figure 3:
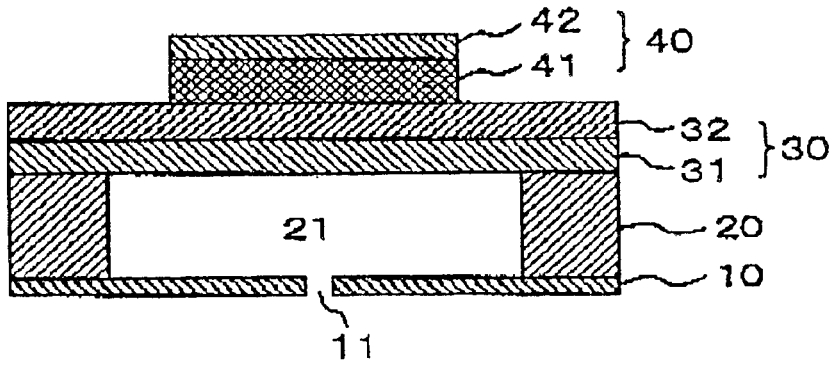
FIG. 3 is a cross-sectional view illustrating a more specific structure of the ink-jet recording head.

FIG. 3 is a cross-sectional view illustrating a more specific structure of the ink-jet recording head. This cross-sectional view is an expanded cross-sectional view of one pressure chamber and one piezoelectric element. As shown in the figure, the oscillation plate 30 is formed by laminating an electrically insulating film 31 and a bottom electrode 32. A piezoelectric element 40 is formed by laminating a piezoelectric thin-film layer 41 and a top electrode 42 on the bottom electrode 32. The ink-jet recording head 1 is formed by arranging the piezoelectric element 40, pressure chamber 21, and nozzle opening 11 in a row at a constant pitch. The pitch between the nozzles can be changed appropriately according to the printing fineness. For example, the components can be arranged so as to obtain 400 dpi (dot per inch).

The electrically insulating film 31 is formed to a thickness of about 1 $\mu$m from a material that is not electrically conductive, for example, from silicon dioxide ($SiO_2$). The electrically insulating film has a configuration such that it can be deformed by the deformation of the piezoelectric thin-film layer and the pressure inside the pressure chamber 21 can be increased instantaneously.

The bottom electrode 32 is one of the electrodes for applying a voltage to the piezoelectric thin-film layer and is formed to a thickness of about 0.2 $\mu$m from an electrically conductive material, for example, from platinum (Pt) and the like. The bottom electrode 32 is formed in the same region as the electrically insulating film 31 so as to function as a common electrode for a plurality of piezoelectric elements formed on the pressure chamber substrate 20. However, it can also be formed to the same size as the piezoelectric thin-film layer 41, that is, to the same shape as the top electrode.

The top electrode 42 is the other electrode for applying a voltage to the piezoelectric thin-film layer. The top electrode 42 is formed to a thickness of about 0.1 $\mu$m from an electrically conductive material, for example, platinum (Pt) or iridium (Ir).

The piezoelectric thin-film layer 41 is a crystal of a piezoelectric ceramic material, for example, such as lead zirconium titanate (PZT) having a perovskite structure. This layer is formed to the prescribed shape on the oscillation plate 30. The thickness of the piezoelectric thin-film layer 41 is preferably no more than 2 $\mu$m, for example, about 1 $\mu$m. The coercive electric field of the piezoelectric thin-film layer is, for example, about $2\times10^6$ V/m.

(Printing Operation)

The printing operation will be explained below with respect to the above-described configuration of the ink-jet recording head 1. If a drive signal is output from the control circuit 8, the feeding mechanism 6 is actuated and paper 5 is transported by the head 1 to a position in which printing can be conducted. When no ejection signal is supplied from the control circuit 8 and no voltage is applied between the bottom electrode 32 and the top electrode 42 of the piezoelectric element 40, no deformation appears in the piezoelectric thin-film layer 41. No pressure changes occur in the pressure chamber 21 provided with the piezoelectric element 40 to which no ejection signal has been supplied, and ink droplets are not ejected from the nozzle opening 11.

On the other hand, when an ejection signal is supplied from the control circuit 8 and a constant voltage is applied between the bottom electrode 32 and the top electrode 42 of piezoelectric element 40, deformation appears in the piezoelectric thin-film layer 41. In the pressure chamber 21 provided with the piezoelectric element 40 to which the ejection signal has been supplied, the oscillation plate 30 thereof deflects to a large degree. As a result, pressure inside the pressure chamber 21 rises instantaneously and ink droplets are ejected from the nozzle opening 11. Any letters or figures can be printed by supplying the ejection signals separately to the piezoelectric elements in positions in the head where printing is to be conducted.

(Drive Unit)

Figure 4:
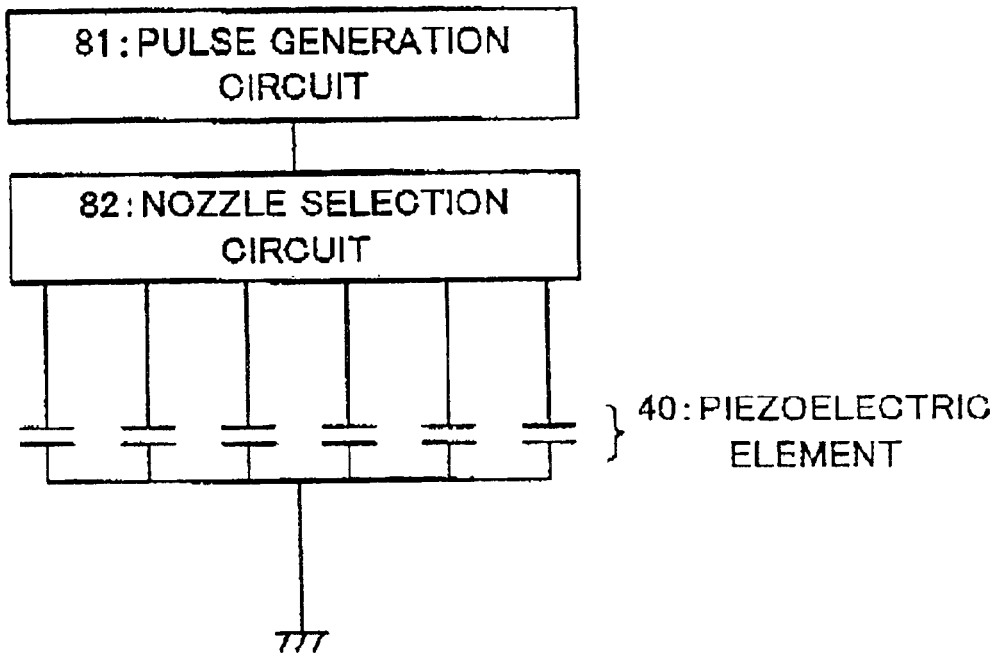
FIG. 4 shows an example of a circuit of the drive unit.

FIG. 4 illustrates a circuit diagram of the drive unit of the present embodiment. As shown in the figure, each of the piezoelectric thin-film elements 40 corresponding to each nozzle (each pressure chamber) of the ink-jet-head is represented as a capacitor on the electric circuit. One electrode of each capacitor is made common and the common electrode is grounded.

The drive unit comprises a pulse generation circuit 81 for generating a drive pulse for driving the piezoelectric thin-film elements 40 and a pulse for eliminating the polarization remaining in the piezoelectric thin-film elements 40, and a nozzle selection circuit 82 for selectively transmitting the drive pulse from the pulse generation circuit 81 to each piezoelectric thin-film element 40.

(Drive Signal)

Figure 5:
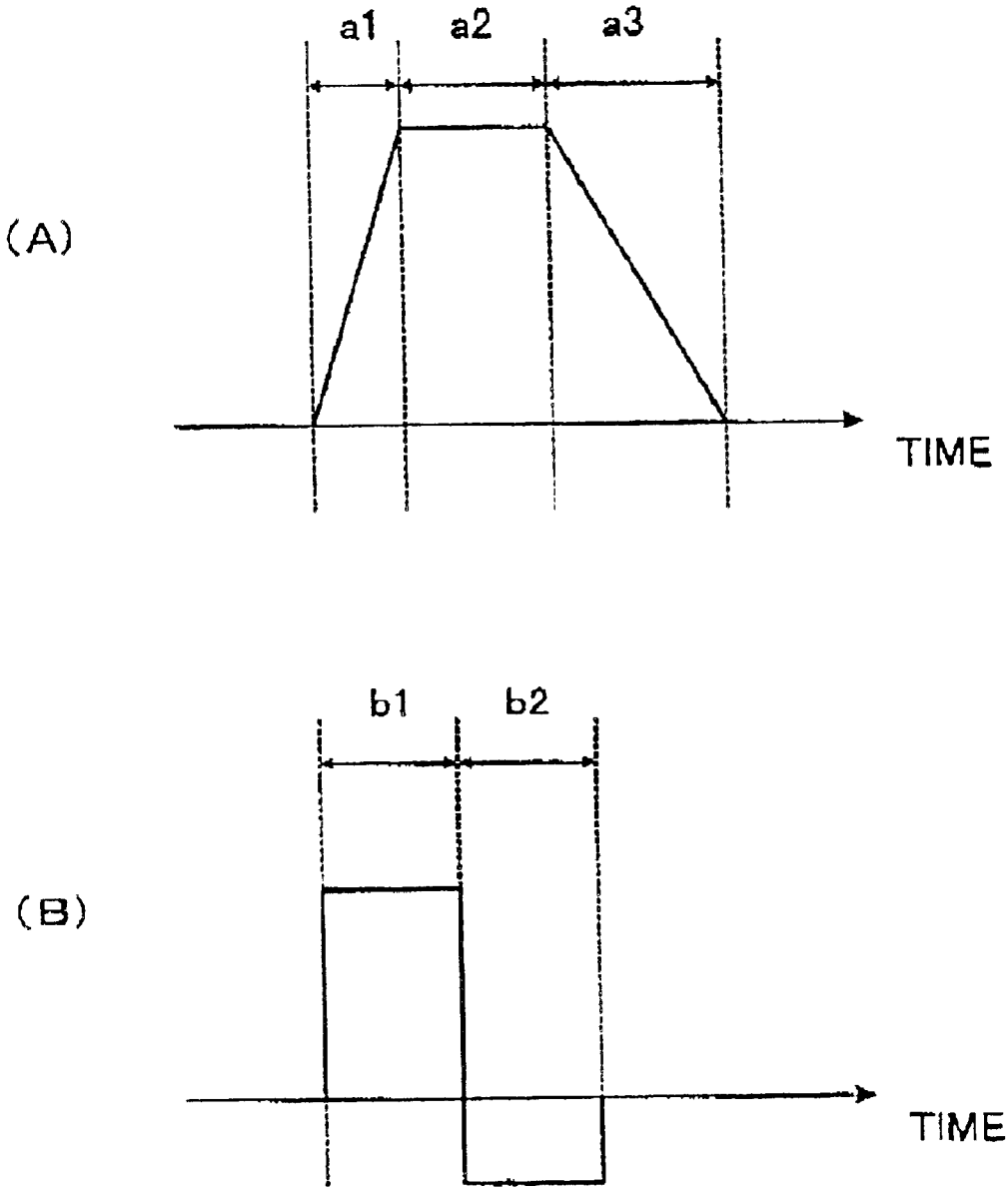
FIG. 5 is a pulse diagram showing an example of voltage pulses applied to a piezoelectric element by the drive unit.

FIG. 5 is a pulse diagram illustrating an example of the voltage pulse applied to the piezoelectric element by the drive unit of the present embodiment. In particular, FIG. 5(A) shows a pulse supplied during ink ejection, and FIG. 5 shows the pulse for polarization elimination.

The pulse supplied during ink ejection, which is shown in FIG. 5(A), comprises a potential increase period a1, a potential maintenance period a2, and a potential decrease period a3. In the potential increase period a1 and the potential maintenance period a2, a voltage is applied to the piezoelectric body and the pressure chamber is caused to shrink. As a result, ink is ejected from the nozzle. In the potential decrease period a3, the pressure chamber is expanded, the non-ejected ink is pulled into the nozzles, and ink is anew pulled in from an ink tank (not shown in the figures). The electric field of piezoelectric body in the potential maintenance period a2 is, for example, $2\times10^7$ through $3\times10^7$ V/m. This value is about 10 times the coercive electric field $2\times10^6$ V/m.

The pulse for polarization elimination, which is shown in FIG. 5(B), comprises a same-polarity voltage application period b1 in which a positive voltage (with the same polarity as the drive pulse) is applied and an inverse-polarity voltage application period b2 in which a negative voltage (with a polarity inverted with respect to that of the drive pulse) is applied immediately after the same-polarity application period. The electric field of piezoelectric thin film in the same-polarity voltage application period b1 is $5\times10^6$ V/m and is higher than the coercive electric field $2\times10^6$ V/m. On the other hand, the electric field of piezoelectric thin film in the inverse-polarity voltage application period b2 is $-2\times10^6$ V/m and is about the same as that of the coercive electric field $2\times10^6$ V/m.

Figure 6:
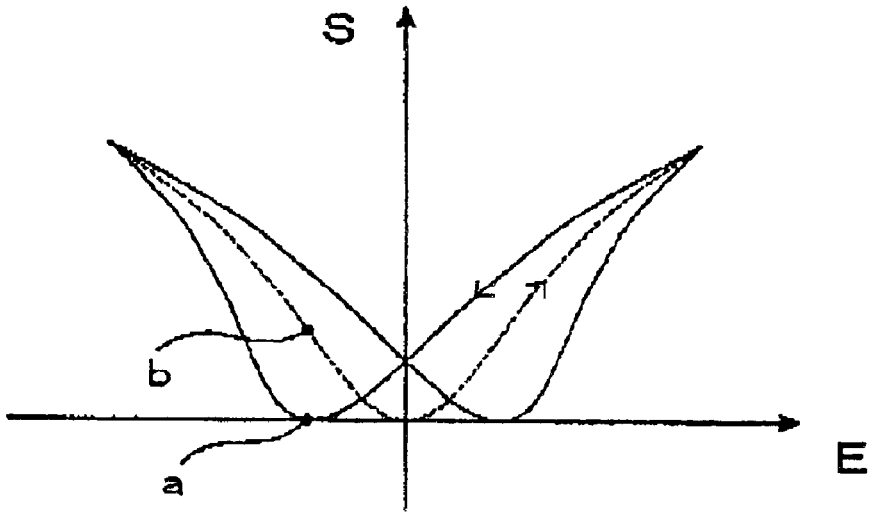
FIG. 6 is a graph illustrating the relationship between the electric field (E) and strain (S) in case when the above-mentioned pulse for polarization elimination was applied.
Figure 7:
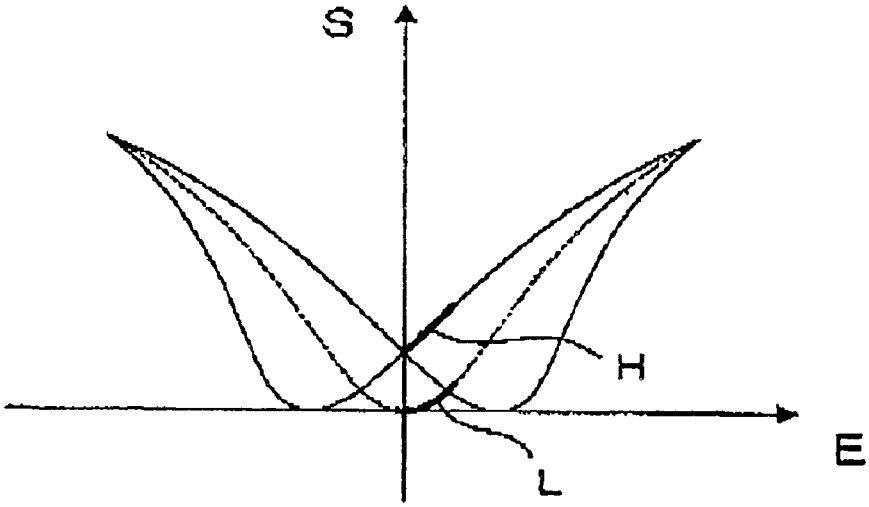
FIG. 7 is a graph illustrating the relationship between strain (S) and electric field (E) of the piezoelectric film.

FIG. 6 is a graph illustrating the relationship between the electric field (E) and strain (S) relating to a case when the above-described pulse for polarization elimination was applied. If the above-described pulse for polarization elimination is applied to the piezoelectric element with no residual polarization, changes follow the arrow shown on the curve in FIG. 6 and a state shown by point "a" is assumed. This state shown by point "a" is also assumed when the above-described pulse for polarization elimination is applied to the piezoelectric element with a residual polarization. In the state shown by point "a", the polarization becomes zero. Therefore, the polarization does not change thereafter as the time elapses and a difference between the elements is prevented.

When only the voltage with a polarity inverted with respect to that of the drive pulse is applied, the elements with no drive history assume the state shown by point "b" and no polarization elimination is conducted.

The above-described pulse application is conducted within time periods when no ink is ejected by the ink-jet head, for example, immediately after the power source of the printer has been turned on, before or after cleaning of the head surface, during cartridge replacement, and after the printed paper has been discharged. However, it is also possible to apply a first voltage to arise an electric field in the piezoelectric body exceeding its coercive electric field to eject ink and immediately apply a second voltage of the polarity opposite to that of said first voltage to eliminate polarization remaining in said piezoelectric body.

According to the drive unit and the drive method for a liquid ejection head of the present invention, it is possible to provide a drive unit for a liquid ejection head with which the variation in displacement among piezoelectric element can be controlled.

What is claimed is:

1. A drive unit for a liquid ejection head in which shrinkage of a pressure chamber and ejection of the liquid are caused by the application of a voltage to a piezoelectric body, comprising:

means for applying a drive pulse with an electric field exceeding the coercive electric field of said piezoelectric body during the liquid ejection operation, the liquid ejection operation including a potential maintenance period, wherein an electric field value of said piezoelectric body in the potential maintenance period is about 10 times the coercive electric field; and means for applying a pulse that eliminates polarization remaining in said piezoelectric body to said piezoelectric body during no liquid ejection operation comprising a same-polarity voltage application period and an inverse-polarity voltage application period, wherein the pulse comprises a same-polarity pulse as the drive pulse and an inverse-polarity pulse with respect to the drive pulse, wherein an electric field value of said piezoelectric body in the same-polarity voltage application period is higher than the coercive electric field and an electric field value of said piezoelectric body in the inverse-polarity voltage application period is similar to the coercive electric field.

2. The drive unit according to claim 1, wherein said pulse which is applied while no liquid ejection operation is conducted is applied at any time period selected from immediately after a power source of the liquid ejection head has been turned on, before or after cleaning of the head surface, during cartridge replacement, and after the liquid discharge operation.

3. The drive unit according to claim 1, wherein said piezoelectric body is a piezoelectric thin film.

4. The liquid ejection apparatus according to claim 3 in which the liquid is ink.

5. A drive unit for a liquid ejection head in which shrinkage of a pressure chamber and ejection of the liquid are caused by the application of a voltage to a piezoelectric body, comprising:

means for applying a drive pulse with an electric field exceeding the coercive electric field of said piezoelectric body to said piezoelectric body during the liquid ejection operation, wherein the liquid ejection operation includes a potential maintenance period and an electric field value of said piezoelectric body during the potential maintenance period is about 10 times the coercive electric field; and means for applying a voltage of the same polarity as said drive pulse and additionally a voltage of the polarity opposite to that of said drive pulse to said piezoelectric body when no liquid ejection operation is conducted, wherein an electric field of value of said piezoelectric body during application of the same-polarity voltage is higher than the coercive electric field and an electric field value of said piezoelectric body during application of the inverse-polarity voltage is similar to the coercive electric field.

6. The drive unit according to claim 5, wherein said pulse which is applied while no liquid ejection operation is conducted is applied at any time period selected from immediately after a power source of the liquid ejection head has been turned on, before or after cleaning of the head surface, during cartridge replacement, and after the liquid discharge operation.

7. A drive unit for a liquid ejection head in which shrinkage of a pressure chamber and ejection of the liquid are caused by the application of a voltage to a piezoelectric body, comprising:

means for applying a first voltage to arise an electric field in the piezoelectric body about 10 times greater than the coercive electric field of said piezoelectric body, and means for applying a second voltage of the polarity opposite to that of said first voltage to said piezoelectric body to eliminate polarization remaining in said piezoelectric body, wherein an electric field value of said piezoelectric body during application of said second voltage is about equivalent to the coercive electric field of said piezoelectric body.

8. A liquid ejection apparatus comprising:

a liquid ejection head; and a drive unit for driving said liquid ejection head, said drive unit including;

means for applying a drive pulse to a piezoelectric body during the liquid ejection operation, wherein an electric field value of the piezoelectric body during application of the drive pulse is about 10 times the coercive electric field of the piezoelectric body; and means for applying a pulse to the piezoelectric body when no liquid ejection operation is conducted, wherein the pulse eliminates polarization remaining in the piezoelectric body.

9. The drive unit according to claim 8, wherein said pulse which is applied while no liquid ejection operation is conducted is applied at any time period selected from immediately after a power source of the liquid ejection head has been turned on, before or after cleaning of the head surface, during cartridge replacement, and after the liquid discharge operation.

10. A drive method for a liquid ejection head in which shrinkage of a pressure chamber and ejection of the liquid are caused by the application of a voltage to a piezoelectric body, said method comprising the steps of:

applying a drive pulse to said piezoelectric body to apply an electric field about 10 times greater than the coercive electric field of said piezoelectric body during the liquid ejection operation, and applying a pulse to said piezoelectric body to eliminate polarization remaining in said piezoelectric body while no liquid ejection operation is conducted.

11. A drive method for a liquid ejection head in which shrinkage of a pressure chamber and ejection of the liquid are caused by the application of a voltage to a piezoelectric body, said method comprising the steps of:

applying a drive pulse to said piezoelectric body to apply an electric field about 10 times greater than the coercive electric field of said piezoelectric body during the liquid ejection operation, and applying a voltage of the same polarity as said drive pulse and additionally applying a voltage of the polarity opposite to that of said drive pulse while no liquid ejection operation is conducted, wherein an electric field value said piezoelectric body during a application of the same-polarity voltage is greater than the coercive electric field of said piezoelectric body and an electric field value of said piezoelectric body during application of the opposite-polarity voltage is about equivalent to the coercive electric field of said piezoelectric body.

12. A drive method for a liquid ejection head in which shrinkage of a pressure chamber and ejection of the liquid are caused by the application of a voltage to a piezoelectric body, comprising the steps of:

applying a first voltage to the piezoelectric body to arise an electric field in the piezoelectric body about 10 times greater than the coercive electric field of the piezoelectric body; and applying a second voltage of a polarity opposite to that of said first voltage to the piezoelectric body to eliminate polarization remaining in the piezoelectric body, wherein an electric field in the piezoelectric body during application of the opposite-polarity voltage is about equivalent to the coercive electric field of the piezoelectric body.

13. A liquid ejection apparatus comprising:

a liquid ejection head; and a drive unit for driving said liquid ejection head, said drive unit including;

means for applying a drive pulse to a piezoelectric body during the liquid ejection operation, wherein the electric field of the piezoelectric body during application of the drive pulse is about 10 times greater than the coercive electric field of the piezoelectric body; and means for applying a voltage of the same polarity as said drive pulse and additionally a voltage of the polarity opposite to that of said drive pulse to the piezoelectric body when no liquid ejection operation is conducted, wherein an electric field value the piezoelectric body during application of the same-polarity voltage is greater than the coercive electric field of the piezoelectric body and an electric field value of the piezoelectric body during a application of the opposite-polarity voltage is about equivalent to the coercive electric field of said piezoelectric body.

* * * * *